United States Patent [19]

Liaaen

[11] 4,046,096

[45] Sept. 6, 1977

[54] VESSEL PROPULSION AND/OR STEERING MEANS

[75] Inventor: Anders Marius Liaaen, Alesund, Norway

[73] Assignee: A.M. Liaaen A/S, Alesund, Norway

[21] Appl. No.: 696,369

[22] Filed: June 15, 1976

[30] Foreign Application Priority Data

June 18, 1975 Norway ..... 752167

[51] Int. Cl.[2] ..... B63H 25/46

[52] U.S. Cl. ..... 115/35; 115/41 R

[58] Field of Search ..... 115/35, 34 R, 41 R, 115/42

[56] References Cited

U.S. PATENT DOCUMENTS

| | | | |
|---|---|---|---|
| 1,199,803 | 10/1916 | McDougall | 115/41 R |
| 2,446,229 | 8/1948 | House | 115/42 |
| 2,987,027 | 6/1961 | Wanzer | 115/41 R |
| 3,013,519 | 12/1961 | Wiggermann | 115/35 |
| 3,734,050 | 5/1973 | Kitai et al. | 115/35 |

*Primary Examiner*—Trygve M. Blix
*Assistant Examiner*—Stuart M. Goldstein
*Attorney, Agent, or Firm*—Watson, Cole, Grindle & Watson

[57] ABSTRACT

Mounting structure for a propulsion and steering apparatus in a vessel comprises a stationary vertical sleeve member mounted within a downwardly open recess in the vessel, an intermediary sleeve member mounted for axial displacement within the stationary sleeve member, and a rotatable hollow steering column mounted within the intermediary sleeve member to extend outside the chamber underneath a submerged portion of the vessel and having mounted at its lower end a nozzle structure for supporting a propeller and gear housing. A separable flange connection supports the upper end of the rotatable steering column from structure associated with rotation of the steering column for steerage of the vessel. A separable shaft interconnects the gear housing to a propulsion motor and extends through the rotatable steering column and the flange connection. The intermediary sleeve is releasably locked to the stationary sleeve member such that disconnection of the flange connection enables the shaft and the rotatable steering column to be lowered within the intermediary sleeve such that a ring on the flange connection rests on an upper portion of the intermediary sleeve. Removal of the releasable locking mechanism enables the intermediary sleeve, a portion of the separable shaft and the rotatable steering column to be lowered axially within the stationary vertical sleeve member for subsequent removal from the vessel while it is afloat.

5 Claims, 3 Drawing Figures

VESSEL PROPULSION AND/OR STEERING MEANS

BACKGROUND OF THE INVENTION

The present invention relates to means adapted to provide a vessel with steering and/or propulsion facilities, mounted underneath a submersed portion of the vessel and comprising a propeller, which may be of the controllable pitch type mounted for rotation about a horizontal axis within a structure defining a nozzle, mounted for rotation about a vertical axis, propeller drive power and nozzle rotation power being supplied from means mounted inside the hull of the vessel.

BRIEF DESCRIPTION OF THE PRIOR ART

Propeller means are previously known possibly of the controllable pitch type, mounted in a fixed position underneath the bottom of a vessel, for propulsion of the same, or for the provision of a lateral manoeuvring thrust. An essential inconvenience of such means is that the vessel has to be dry docked if the means is to be maintained or repaired.

Means are also known, intended to avoid the docking necessity, wherein the propeller is mounted at the lower end of a vertical tunnel or well extending upwardly through the vessel, so that the means may be lifted to the top portion of the tunnel, above the water line, for maintenance and repair. However, such an arrangement is very space consuming, and often necessitates a dismounting of drive motor and other equipment prior to the lifting of the propeller means.

Further, arrangements are known, wherein the propeller means with drive motor and auxiliary equipment are mounted in a tank extending vertically upwards through the vessel, possibly to the top of the same and wherein the entire tank is lifted out for the purpose of effecting maintenance work. In such an arrangement very powerful lifting gears, usually not provided aboard a vessel, are required.

SUMMARY OF THE INVENTION

Consequently, it is a purpose of the present invention to provide a propeller means not presenting the inconveniences referred to above, and which may be applied in any vessel, but is of particular interest when applied to pontoons or floating bodies intended to support equipment for exploration and/or exploitation of the sea bottom. Such as semi submersile exploration or drilling installations. In connection with such installations, which must be kept in position when in operation, and which could not be docked without great difficulties, it is of interest to provide a propeller means which may be adapted both for propulsion of the installation or vessel when such propulsion is desired, and for positioning the same, and which is easily replaced or temporarily removed for maintenance or repair purposes while the installation or vessel is afloat.

According to the invention, this problem is solved by means of a vessel propulsion and/or steering means of the type comprising a propeller mounted for rotation about a horizontal axis within a nozzle and mounted for rotation about a vertical axis underneath a submersed portion of the vessel, and means mounted within the vessel and adapted to supply motive power to the shaft of the propeller and rotational power to a column carrying the nozzle structure through connection means adapted to enable mounting and dismounting of the propeller and nozzle means under water, the propeller drive shaft and the tunnel structure column being received in a downwardly open recess in the vessel, the nozzle structure column being mounted in a stationary sleeve through an intermediary sleeve so that the said column may be rotated in the intermediary sleeve for the purpose of rotating the propeller and nozzle unit, and so that the column and the intermediary sleeve may be axially displaced relatively to each other for the purpose of mounting and dismounting of the said unit.

Further details of the means according to the invention, will appear from the following description, taken together with the accompanying drawings, and from the claims.

BRIEF DESCRIPTION OF THE FIGURES

In the drawings,

In FIG. 1, 1 and 2 are a deck and bottom, respectively of a vessel which may be a conventional vessel, a pontoon or a wholly or partially submersible part of an operation platform structure, for instance intended for exploration of or drilling in a sea bottom. By means of walls 3 and floors 4 and 5, three spaces 6, 7 and 8 are formed between the deck 1 and the bottom 2 of the vessel, each space being adapted to accommodate a portion of the means according to the invention. Two passage ways 9 are carried through the three spaces for the passage of a pair of wires 10, which at the top are shown to be connected to a yoke 11 associated with a lifting device 12. The purpose of the members 10, 11 and 12 will be explained below.

As shown in FIG. 1, the means comprises a propeller 13, which in the embodiment shown is a controllable pitch propeller, which is supported by a gear housing 14 containing means for the rotation of the propeller and setting of the blade pitch. The propeller 13 with its gear housing 14 is mounted in a nozzle 15 which, at 16, is connected to the gear housing 14. When in operation, the entire propeller unit 13 to 16 may be rotated about a vertical axis situated in the plane of the drawing, for the purpose of steering the vessel.

Figure 1:
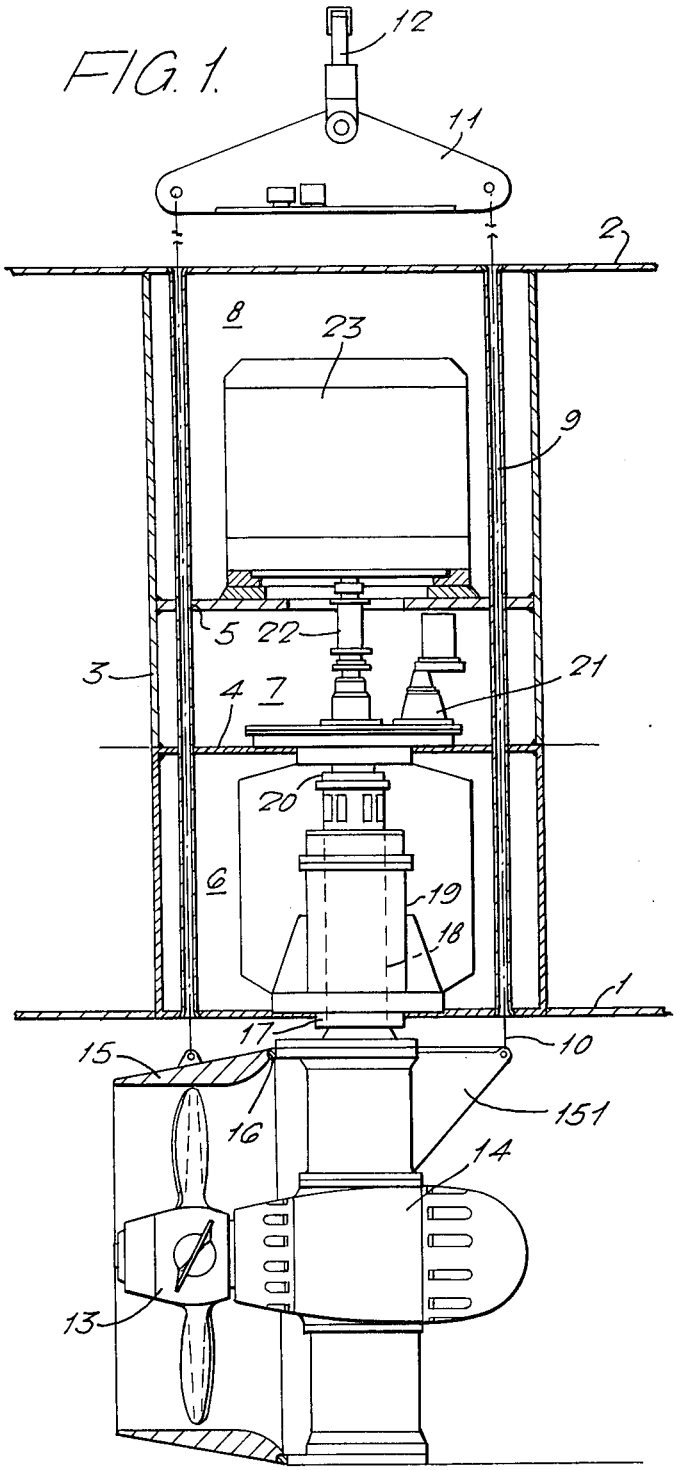
FIG. 1 is a side view of the means, partly in section, as installed in a vessel.

The gear housing structure supporting the propeller unit is connected to a rotatable steering column 18 which is mounted in a sleeve 19 situated in the space 6, under use of a sealing box 17.

The sleeve 19 is secured to the bottom 1, and the steering column 18 is, through a flange connection 20 the upper end of the steering column structure, connected to a steering motor 21 is accommodated in the space 7 on the floor 4, while the propeller 13 is associated with an engine 23, preferably an electric motor, through a shaft 22, the motor 23 being mounted on the floor 5 in the space 8 underneath the deck 2.

Through the motor 23 and the shaft 22 rotational drive is supplied to the propeller 13, whereas the rotation of the entire propeller unit about its vertical axis, is achieved by means of at least one steering engine 21, through gears and the steering column 18.

Figure 2:
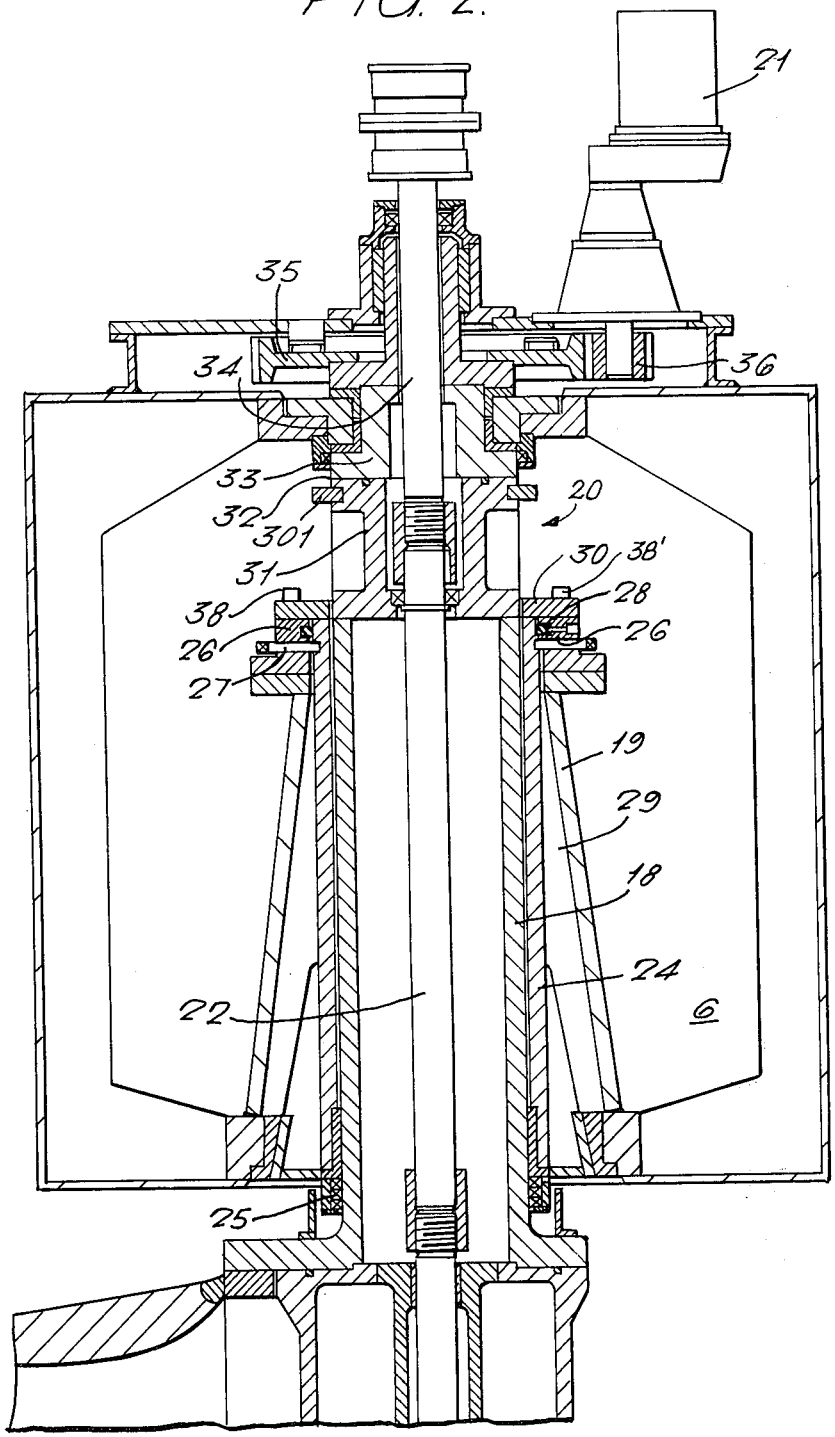
FIG. 2 is a sectional view taken along the vertical axis of the means, through essential parts of the means.

Under reference also to FIG. 2, the means adapted to permit a water tight mounting and dismounting of the propeller unit are now to be described, i.e. particularly the means accomodated in the space 6.

As indicated the propeller unit 13 to 16 is carried by the steering column 18.

The mounting of the column 18 in the sleeve 19 is effected through an intermediary sleeve 24 provided with seals 25, so that the column 18 may be both rotated and moved axially relatively to the sleeve 24. At the top end of the sleeve 19, an annular flanged extension 26 is arranged, through which radial locking pins 27, possibly in the form of half rings, are received for the purpose of releasably locking the extension 26 together with its sleeve 19, to the intermediate sleeve 24. In an annular recess in the inner cylindrical surface of the extension 26, a rubber seal 28 is arranged above the pins 27, adapted to be inflated for the purpose of providing a seal to the space 29 between the intermediary sleeve 24 and the sleeve 19 above the space 6, and thereby against the interior of the vessel. A split ring 30 is secured at the top end of the extension 26 through bolts 38 38'. As described below, the ring 30 provides an alternative sealing and locking to that provided by the rubber seal 28 and the locking pins 27.

An extension 31 is secured to the top end of the steering column 18 and is flanged, at 32, to a flange 33 on a shaft 34 which through gears 35, 36 is driven by at least one steering motor 21 arranged around the axis of the column 18.

It is now to be described how the propeller unit with its steering column may be removed from the position shown in the drawings for the purpose of effecting maintenance, repair or similar work.

Figure 3:
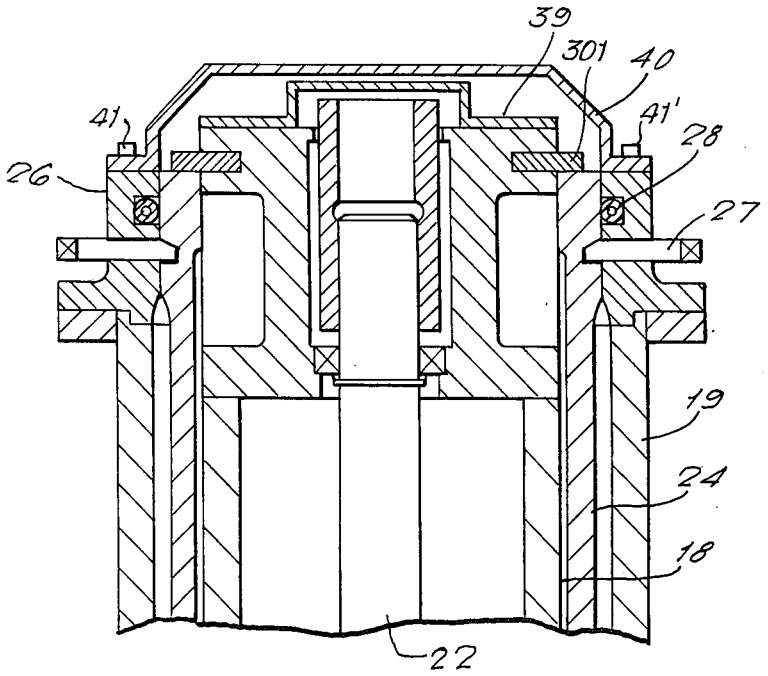
FIG. 3 is an axial sectional view of a detail of the means.

From the yoke 11, which is suspended in the lifting device 12 above the deck 2 each of the wires 10 is run downwardly through its passageway 9 and is connected to the propeller nozzle structure 15 and to a bracket 151 on the gear housing 14, respectively. The wires are tensioned to a holding force just above the total weight of the propeller unit with its steering column. The rubber seal 28 is inflated to sealing position, whereupon the alternative sealing ring 30 is removed and the flange connection 20 between the column 18 and the steering motor 21 is loosened at 32. By means of the wires 10, the propeller unit with its column is now lowered until the ring 301, which is engaging the top flange of the extension 31, abuts against the end face of the intermediate sleeve 24, and is then bolted to the same, as shown in FIG. 3. A cover 39, FIG. 3, is now placed over extension slot the upper end of the steering column 18 for the purpose of sealing the upper end of the steering column structure. A further cover 40 is then fastened to the extension 26 by bolts 41, 41' for the purpose of sealing the interior of the vessel against the hollow space which is now formed inside of the sleeve 19 with its extension 26.

The wires 10 are now tightened and the pins 27 removed so that the propeller unit with its steering column 18 and the intermediate sleeve 24 may be lowered out of engagement with the sleeve 19 and is then, through suitable control of the lifting device 12 and application of further auxiliary lifting equipment, not shown, swung free of the vessel hull and lifted to the water surface, while the hollow space in the sleeve 19 is effectively sealed by means of the cover 40.

When the propeller unit is to be mounted the sequence discribed is effected in the reverse order.

I claim:

1. Structure for mounting a propulsion and steering apparatus in a vessel, comprising:

a stationary vertical sleeve member mounted within a sealed chamber in the vessel;

an intermediary sleeve member mounted for axial displacement within said stationary sleeve member;

a rotatable hollow steering column mounted within said intermediary sleeve member and extending outside said chamber underneath a submerged portion of said vessel and including at its lower end a nozzle structure mounted thereon for supporting a propeller and gear housing;

flange connection means including first and second flange members, said first flange member being mounted to the upper end of said rotatable steering column and including a ring member, said first and second flange members releasably engaging one another;

a separable shaft interconnecting said gear housing to a motor and extending through said rotatable steering column and said first and second flange members;

means for releasably locking said intermediary sleeve to said stationary sleeve member, whereby disconnection of said first and second flange members enables said first flange member, said shaft and said rotatable steering column to be lowered within said intermediary sleeve such that said ring member rests on the upper portion thereof adjacent said upper end of said rotatable steering column, and removal of said releasable locking means enables said intermediary sleeve, a portion of said separable shaft and said rotatable steering column to be lowered axially within said stationary vertical sleeve member.

2. Structure as in claim 1 further comprising means attached to said nozzle structure for lowering and lifting the same whereby said intermediary sleeve, said portion of said separable shaft and said rotatable steering column are removed from, and inserted within, said stationary sleeve member.

3. Structure as in claim 1 further comprising inflatable sealing means at the upper end of said rotatable steering column and positioned between said intermediary sleeve and said stationary sleeve member to provide a seal therebetween.

4. Structure as in claim 1 further comprising means for covering said stationary sleeve member adjacent said ring member with said ring member abutting said intermediary sleeve member.

5. Structure as in claim 4 further comprising a second cover for covering the upper portion of said rotatable steering column with said ring member abutting said intermediary sleeve member.

* * * * *